US010186844B2

(12) United States Patent
Kobayashi et al.

(10) Patent No.: US 10,186,844 B2
(45) Date of Patent: Jan. 22, 2019

(54) SPARK PLUG

(71) Applicant: NGK SPARK PLUG CO., LTD., Nagoya-shi, Aichi (JP)

(72) Inventors: Tsutomu Kobayashi, Inazawa (JP); Tomoyuki Igarashi, Kusugai (JP)

(73) Assignee: NGK SPARK PLUG CO., LTD., Nagoya-shi (JP)

( * ) Notice: Subject to any disclaimer, the term of this patent is extended or adjusted under 35 U.S.C. 154(b) by 0 days.

(21) Appl. No.: 15/302,673

(22) PCT Filed: Mar. 3, 2015

(86) PCT No.: PCT/JP2015/001115

§ 371 (c)(1),
(2) Date: Oct. 7, 2016

(87) PCT Pub. No.: WO2015/155927

PCT Pub. Date: Oct. 15, 2015

(65) Prior Publication Data

US 2017/0033538 A1 Feb. 2, 2017

(30) Foreign Application Priority Data

Apr. 9, 2014 (JP) ..... 2014-079844

(51) Int. Cl.
*H01T 13/20* (2006.01)
*H01T 13/16* (2006.01)
(Continued)

(52) U.S. Cl.
CPC ..... *H01T 13/16* (2013.01); *H01T 13/00* (2013.01); *H01T 13/20* (2013.01); *H01T 13/36* (2013.01)

(58) Field of Classification Search
CPC ..... H01T 13/00; H01T 13/20; H01T 13/06; H01T 13/16; H01T 13/36
See application file for complete search history.

(56) References Cited

U.S. PATENT DOCUMENTS 2,620,784 A * 12/1952 Cipriani ..... H01T 13/36 174/152 S
3,612,931 A * 10/1971 Strumbos ..... H01T 13/16 313/11.5
(Continued)

FOREIGN PATENT DOCUMENTS

JP H02-183989 A 7/1990 ..... F02P 13/00
WO WO 2011/125306 A1 10/2011 ..... H01T 13/36
WO WO 2014/013654 1/2014 ..... H01T 13/36

OTHER PUBLICATIONS

International Search Report issued in corresponding International Patent Application No. PCT/JP2015/001115, dated Apr. 21, 2015.

*Primary Examiner* — Joseph L Williams
*Assistant Examiner* — Jose M Diaz
(74) *Attorney, Agent, or Firm* — Kusner & Jaffe

(57) ABSTRACT

A spark plug that satisfies the relation 2.8≤(A+B)/M, where A is the sum of a length A1 of contact between a sheet packing and a metallic shell of a spark plug in one half section and a length A2 of contact between the sheet packing and the insulator in the one half section, and B is the sum of a length B1 of contact between the sheet packing and the metallic shell in the other half section and a length B2 of contact between the sheet packing and the insulator in the other half section. M is the difference obtained by subtracting the inner diameter D of a ledge from the inner diameter C of a middle hole portion.

6 Claims, 13 Drawing Sheets

(51) Int. Cl.
*H01T 13/00* (2006.01)
*H01T 13/36* (2006.01)

(56) References Cited

U.S. PATENT DOCUMENTS

| | | | | | |
|---|---|---|---|---|---|
| 4,491,101 | A * | 1/1985 | Strumbos | H01T 13/16 | 123/169 C |
| 5,831,377 | A * | 11/1998 | Matsubara | H01T 13/20 | 313/118 |
| 7,183,702 | B2 * | 2/2007 | Kanao | H01T 13/20 | 313/118 |
| 2007/0126330 | A1 * | 6/2007 | Kuki | H01T 13/36 | 313/143 |
| 2008/0054778 | A1 * | 3/2008 | Kumagai | H01T 13/36 | 313/143 |
| 2011/0181168 | A1 * | 7/2011 | Nakamura | H01T 13/36 | 313/144 |
| 2011/0298353 | A1 * | 12/2011 | Nakamura | H01T 13/36 | 313/145 |
| 2013/0015756 | A1 | 1/2013 | Yamada et al. | 313/143 | |
| 2015/0188293 | A1 | 7/2015 | Ozeki et al. | H01T 13/36 | |
| 2015/0188294 | A1 * | 7/2015 | Nishida | H01B 3/12 | 174/110 R |
| 2015/0340842 | A1 * | 11/2015 | Ozeki | H01T 13/36 | 313/143 |

* cited by examiner

| SAMPLE | NOMINAL DIAMETER OF THREADED PORTION | MATERIAL OF PACKING | LENGTH A (= A1 + A2) [mm] | LENGTH B (= B1 + B2) [mm] | DIFFERENCE IN INNER DIAMETER M (= C – D) [mm] | (A + B)/M | NUMBER OF KNOCKING EVENTS | EVALUATION |
|---|---|---|---|---|---|---|---|---|
| A1 | M10 | CARBON STEEL (C: 0.15%) | 1.79 | 1.77 | 1.3 (C = 6.5) (D = 5.2) (J = 6.3) | 2.738 | 9 | C |
| A2 | ↑ | ↑ | 1.85 | 1.80 | | 2.808 | 3 | B |
| A3 | ↑ | ↑ | 1.94 | 1.90 | | 2.954 | 0 | A |
| A4 | M12 | ↑ | 1.78 | 1.77 | 1.3 (C = 7.5) (D = 6.2) (J = 7.3) | 2.731 | 8 | C |
| A5 | ↑ | ↑ | 1.86 | 1.81 | | 2.823 | 4 | B |
| A6 | ↑ | ↑ | 1.91 | 1.92 | | 2.946 | 0 | A |
| A7 | M14 | ↑ | 2.19 | 2.15 | 1.6 (C = 9.5) (D = 7.9) (J = 9.2) | 2.713 | 8 | C |
| A8 | ↑ | ↑ | 2.22 | 2.30 | | 2.825 | 3 | B |
| A9 | ↑ | ↑ | 2.36 | 2.31 | | 2.919 | 0 | A |

FIG. 8

| SAMPLE | NOMINAL DIAMETER OF THREADED PORTION | MATERIAL OF PACKING | LENGTH A (= A1 + A2) [mm] | LENGTH B (= B1 + B2) [mm] | DIFFERENCE IN INNER DIAMETER M (= C − D) [mm] | (A + B)/M | NUMBER OF KNOCKING EVENTS | EVALUATION |
|---|---|---|---|---|---|---|---|---|
| A11 | M10 | CARBON STEEL (C: 0.10%) | 1.77 | 1.79 | 1.3 (C = 6.5) (D = 5.2) (J = 6.3) | 2.738 | 9 | C |
| A12 | ↑ | ↑ | 1.88 | 1.81 | | 2.838 | 4 | B |
| A13 | ↑ | ↑ | 1.90 | 1.91 | | 2.931 | 0 | A |
| A14 | ↑ | CARBON STEEL (C: 0.25%) | 1.69 | 1.73 | ↑ | 2.631 | 10 | C |
| A15 | ↑ | ↑ | 1.86 | 1.80 | | 2.815 | 3 | B |
| A16 | ↑ | ↑ | 1.89 | 1.92 | | 2.931 | 0 | A |
| A17 | ↑ | CARBON STEEL (C: 0.45%) | 1.75 | 1.76 | ↑ | 2.700 | 8 | C |
| A18 | ↑ | ↑ | 1.83 | 1.84 | | 2.823 | 2 | B |
| A19 | ↑ | ↑ | 1.94 | 1.91 | | 2.962 | 0 | A |

FIG. 9

| SAMPLE | VICKERS HARDNESS | | LENGTH A (= A1 + A2) [mm] | LENGTH B (= B1 + B2) [mm] | (A + B)/M | NUMBER OF KNOCKING EVENTS | EVALUATION |
|---|---|---|---|---|---|---|---|
| | METALLIC SHELL E | PACKING F | | | | | |
| B1 | 199 | 183 | 1.85 | 1.82 | 2.823 | 3 | B |
| B2 | 232 | 179 | 1.89 | 1.86 | 2.885 | 1 | B |
| B3 | 241 | 181 | 1.94 | 1.87 | 2.931 | 0 | A |
| B4 | 250 | 189 | 1.94 | 1.91 | 2.962 | 0 | A |
| B5 | 201 | 200 | 1.82 | 1.82 | 2.800 | 3 | B |
| B6 | 233 | 197 | 1.87 | 1.85 | 2.862 | 2 | B |
| B7 | 240 | 199 | 1.90 | 1.88 | 2.908 | 0 | A |
| B8 | 253 | 203 | 1.92 | 1.89 | 2.931 | 0 | A |

FIG. 10

| SAMPLE | VICKERS HARDNESS | | LENGTH A (= A1 + A2) [mm] | LENGTH B (= B1 + B2) [mm] | (A + B)/M | NUMBER OF KNOCKING EVENTS | EVALUATION |
|---|---|---|---|---|---|---|---|
| | METALLIC SHELL E | PACKING F | | | | | |
| B9 | 197 | 222 | 1.82 | 1.83 | 2.808 | 3 | B |
| B10 | 229 | 223 | 1.85 | 1.84 | 2.838 | 1 | B |
| B11 | 242 | 220 | 1.89 | 1.89 | 2.908 | 0 | A |
| B12 | 251 | 222 | 1.93 | 1.90 | 2.946 | 0 | A |
| B13 | 198 | 248 | 1.82 | 1.82 | 2.800 | 4 | B |
| B14 | 231 | 251 | 1.83 | 1.82 | 2.808 | 2 | B |
| B15 | 241 | 253 | 1.88 | 1.84 | 2.862 | 2 | B |
| B16 | 247 | 250 | 1.90 | 1.86 | 2.892 | 1 | B |

FIG. 11

| SAMPLE | THICKNESS OF PACKING TP [mm] | VICKERS HARDNESS | | LENGTH A (= A1 + A2) [mm] | LENGTH B (= B1 + B2) [mm] | (A + B)/M | NUMBER OF KNOCKING EVENTS | EVALUATION |
|---|---|---|---|---|---|---|---|---|
| | | METALLIC SHELL E | PACKING F | | | | | |
| C1 | 0.35 | 241 | 219 | 1.90 | 1.89 | 2.915 | 5 | C |
| C2 | 0.30 | 245 | 220 | 1.89 | 1.91 | 2.923 | 4 | B |
| C3 | 0.25 | 244 | 221 | 1.91 | 1.90 | 2.931 | 1 | B |
| C4 | 0.20 | 244 | 217 | 1.88 | 1.91 | 2.915 | 0 | A |
| C5 (B11) | 0.15 | 242 | 220 | 1.89 | 1.89 | 2.908 | 0 | A |

FIG. 12

| SAMPLE | LENGTH A (= A1 + A2) [mm] | LENGTH B (= B1 + B2) [mm] | (A + B)/M | LENGTH AO [mm] | LENGTH AI [mm] | LENGTH BO [mm] | LENGTH BI [mm] | (AI + BI)/ (AO + BO) | NUMBER OF KNOCKING EVENTS | EVALUATION |
|---|---|---|---|---|---|---|---|---|---|---|
| D1 | 1.86 | 1.93 | 2.846 | 0.56 | 0.44 | 0.53 | 0.45 | 0.82 | 8 | C |
| D2 (B11) | 1.89 | 1.89 | 2.908 | 0.51 | 0.49 | 0.49 | 0.49 | 0.98 | 4 | B |
| D3 | 1.92 | 1.84 | 2.892 | 0.46 | 0.54 | 0.47 | 0.51 | 1.13 | 0 | A |
| D4 | 1.90 | 1.95 | 2.962 | 0.43 | 0.57 | 0.44 | 0.54 | 1.28 | 0 | A |

FIG. 13

SPARK PLUG

RELATED APPLICATIONS

This application is a National Stage of International Application No. PCT/JP15/01115filed Mar. 3, 2015, which claims the benefit of Japanese Patent Application No. 2014-079844, filed Apr. 9, 2014.

FIELD OF THE INVENTION

The present invention relates to a spark plug.

BACKGROUND OF THE INVENTION

One known spark plug includes an insulator that internally holds a center electrode and a metallic shell that internally holds the insulator. In such a spark plug, a sheet packing is held between the insulator and the metallic shell in order to ensure air tightness therebetween (see, for example, WO 2011/125306).

When the temperature of the center electrode of the spark plug is excessively high (e.g., 950° C. or higher), pre-ignition occurs in which the center electrode serves as a heat source and causes ignition to occur before spark discharge is generated. In a spark plug, its heat range (heat dissipation properties), which is the degree of dissipation of heat which the center electrode receives as a result of combustion to its surroundings, has been adjusted in order to prevent pre-ignition. One path for heat dissipation from the center electrode is a path extending from the insulator holding the center electrode through the sheet packing to the metallic shell. The heat of the metallic shell is released to the cylinder head of the internal combustion engine to which the spark plug is mounted.

In recent years, to achieve an improvement in the output power of an internal combustion engine and an improvement in its fuel economy simultaneously, there is a need for an increase in the set temperature of the combustion chamber. From the viewpoint of increasing the design flexibility of the internal combustion engine, there is a need for a reduction in the size of the spark plug. Under these circumstances, heat resulting from combustion tends to be accumulated in the spark plug.

In the spark plug in WO 2011/125306, there are no sufficient studies on how to dissipate heat sufficiently through a path extending from the insulator through the sheet packing to the metallic shell.

SUMMARY OF THE INVENTION

The present invention has been made in order to address the foregoing problem and can be embodied in the following modes.

(1) According to one mode of the present invention, there is provided a spark plug comprising a tubular insulator extending in an axial direction, parallel to an axial line, from a rear end side toward a forward end side, the insulator having a step portion having a surface facing the forward end side; a tubular metallic shell for holding the insulator there inside, the metallic shell including a ledge that supports the step portion and a middle hole portion located on the rear end side of the ledge and connected to the ledge; and a sheet packing held between the step portion and the ledge. In this spark plug, $2.8 \leq (A+B)/M$ holds, where A (mm) is a sum of a length A1 (mm) and a length A2 (mm), the length A1 being a length of contact between the sheet packing and the metallic shell in one of two half sections obtained by dividing, by the axial line, a cross section of the spark plug that passes through the axial line, the length A2 being a length of contact between the sheet packing and the insulator in the one of the two half sections, B (mm) is a sum of a length B1 (mm) and a length B2 (mm), the length B1 being a length of contact between the sheet packing and the metallic shell in the other one of the two half sections that is different from the one of the two half sections, the length B2 being a length of contact between the sheet packing and the insulator in the other one of the two half sections, and M (mm) is a difference obtained by subtracting an inner diameter D (mm) of the ledge from an inner diameter C (mm) of the middle hole portion. In this mode, the area of contact between the insulator and the sheet packing and the area of contact between the sheet packing and the metallic shell can be ensured sufficiently. Therefore, heat dissipation through a path from the insulator through the sheet packing to the metallic shell can be improved.

(2) In accordance with a second aspect of the present invention, there is provided a spark plug, as described above, wherein an average Vickers hardness E of a portion of the metallic shell that is located at a depth of 0.2 mm from an interface between the metallic shell and the sheet packing in the cross section may be 240 HV or more, and an average Vickers hardness F of the sheet packing in the cross section may be 100 HV or more and less than the average Vickers hardness E. In this mode, the sheet packing is prevented from being deformed excessively to thereby prevent the position of the insulator relative to the metallic shell from being excessively displaced toward the forward end side. In addition, the heat dissipation through the path from the insulator through the sheet packing to the metallic shell can be improved.

(3) In accordance with a third aspect of the present invention, there is provided a spark plug, as described above, wherein the ledge may have an inner surface facing the rear end side, and a thickness of the sheet packing at a midpoint of the inner surface in the cross section may be 0.15 mm or more and 0.20 mm or less. In this mode, a sufficient allowance for deformation of the sheet packing is ensured to thereby maintain the accuracy of installation of the insulator to the metallic shell. In addition, the heat dissipation through the path from the insulator through the sheet packing to the metallic shell can be improved.

(4) In accordance with a fourth aspect of the present invention, there is provided a spark plug, as described above, wherein a male thread with a nominal diameter equal to or less than M14 may be formed on an outer circumference of the metallic shell. In this mode, the spark plug in which the male thread with a nominal diameter of M14 or less is formed on the metallic shell can have improved heat dissipation properties.

(5) In accordance with a fifth aspect of the present invention, there is provided a spark plug, as described above, wherein the nominal diameter of the male thread may be equal to or less than M10. In this mode, the spark plug in which the male thread with a nominal diameter of M10 or less is formed on the metallic shell can have improved heat dissipation properties.

(6) In accordance with a sixth aspect of the present invention, there is provided a spark plug, as described above, wherein the middle hole portion may have a first inner surface along the axial line, the ledge may have a second inner surface along the axial line and a third inner surface located between the first inner surface and the second inner surface and facing the rear end side, and a relation $1.1 \leq (AI+$ BI)/(AO+BO) may hold, where AO is a length of contact between the sheet packing and the insulator on an outer circumferential side with respect to a perpendicular line PL1 in the one of the two half sections, the perpendicular line PL1 being drawn from a midpoint of the third inner surface in the one of the two half sections, AI is a length of contact between the sheet packing and the insulator on an inner circumferential side with respect to the perpendicular line PL1 in the one of the two half sections, BO is a length of contact between the sheet packing and the insulator on an outer circumferential side with respect to a perpendicular line PL2 in the other one of the two half sections, the perpendicular line PL2 being drawn from a midpoint of the third inner surface in the other one of the two half sections, and BI is a length of contact between the sheet packing and the insulator on an inner circumferential side with respect to the perpendicular line PL2 in the other one of the two half sections. In this mode, the sheet packing is in contact with the insulator to a larger extent on the forward end side than on the rear end side. Therefore, the heat dissipation through the path from the insulator through the sheet packing to the metallic shell can be effectively improved.

The present invention can be embodied in various forms other than the spark plug. For example, the present invention can be embodied as a component of the spark plug, a method of producing the spark plug, etc.

BRIEF DESCRIPTION OF THE DRAWINGS

FIG. 8 is a table showing the results of evaluation of the value of (A+B)/M.

FIG. 9 is a table showing the results of evaluation of the value of (A+B)/M.

FIG. 10 is a table showing the results of evaluation of the average Vickers hardness E of a metallic shell and the average Vickers hardness F of an insulator.

FIG. 11 is a table showing the results of evaluation of the average Vickers hardness E of the metallic shell and the average Vickers hardness F of the insulator.

FIG. 12 is a table showing the results of evaluation of the thickness TP of the sheet packing.

FIG. 13 is a table showing the results of evaluation of the value of (AI+BI)/(AO+BO).

DETAILED DESCRIPTION OF THE PREFERRED EMBODIMENTS

A. First embodiment

A-1. Configuration of Spark Plug

Figure 1:
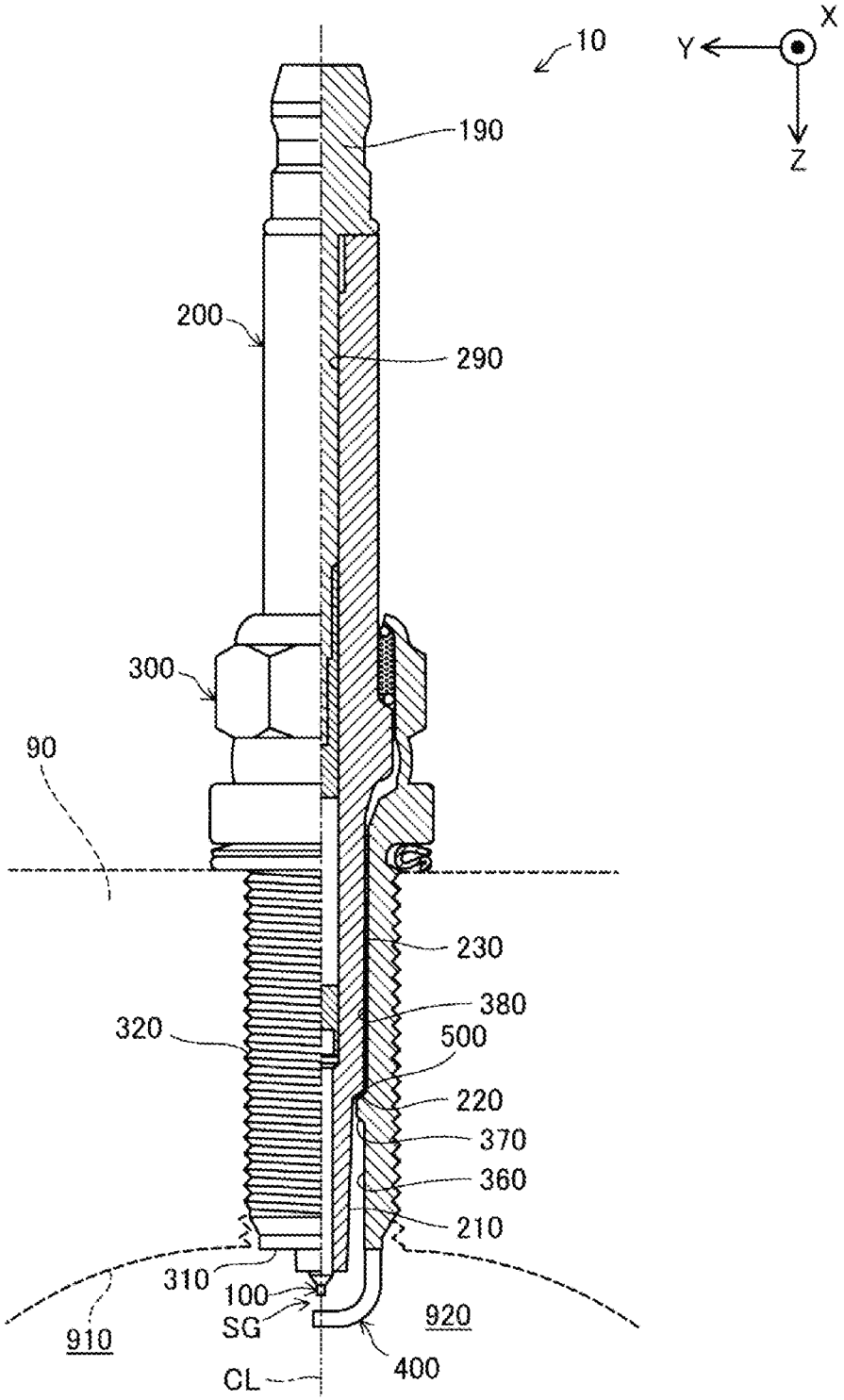
FIG. 1 is an illustration showing a partial cross section of a spark plug.

FIG. 1 is an illustration showing a partial cross section of a spark plug 10. In FIG. 1, the exterior shape of the spark plug 10 is shown on the left side of the sheet with respect to an axial line CL, i.e., the axis of the spark plug 10, and a cross-sectional shape of the spark plug 10 is shown on the right side of the sheet with respect to the axial line CL. In the description of the present embodiment, the lower side in the sheet of FIG. 1 is referred to as a "forward end side" of the spark plug 10, and the upper side in the sheet of FIG. 1 is referred to as a "rear end side."

The spark plug 10 includes a center electrode 100, an insulator 200, a metallic shell 300, a ground electrode 400, and a sheet packing 500. In the present embodiment, the axial line CL of the spark plug 10 is also the axis of the center electrode 100, the axis of the insulator 200, and the axis of the metallic shell 300.

The spark plug 10 has at its forward end a gap SG formed between the center electrode 100 and the ground electrode 400. The gap SG of the spark plug 10 is referred to also as a spark gap. The spark plug 10 is configured so as to be mountable to an internal combustion engine 90 with the forward end at which the gap SG is formed protruding from an inner wall 910 of a combustion chamber 920. When a high voltage (e.g., 10,000 to 30,000 V) is applied to the center electrode 100 with the spark plug 10 mounted to the internal combustion engine 90, spark discharge is generated in the gap SG. The spark discharge generated in the gap SG causes ignition of an air-fuel mixture in the combustion chamber 920.

Mutually orthogonal XYZ axes are shown in FIG. 1. The XYZ axes shown in FIG. 1 correspond to XYZ axes in other figures described later.

Among the XYZ axes in FIG. 1, the X axis is an axis orthogonal to the Y and Z axes. X axis directions along the X axis include a +X axis direction directed frontward from the sheet of FIG. 1 and a −X axis direction opposite the +X axis direction.

Among the XYZ axes in FIG. 1, the Y axis is an axis orthogonal to the X and Z axes. Y axis directions along the Y axis include a +Y axis direction directed from the right side of the sheet of FIG. 1 to the left side thereof and a −Y axis direction opposite the +Y axis direction.

Among the XYZ axes in FIG. 1, the Z axis is an axis along the axial line CL. Z axis directions (axial directions) along the Z axis include a +Z axis direction directed from the rear end side of the spark plug 10 toward the forward end side and a −Z axis direction opposite the +Z axis direction.

The center electrode 100 of the spark plug 10 is an electrically conductive electrode. The center electrode 100 has a rod-like shape extending with the axial line CL at its center. In the present embodiment, the material of the center electrode 100 is a nickel alloy containing nickel (Ni) as a main component (for example, INCONEL (registered trademark) 600). The outer surface of the center electrode 100 is electrically insulated from the outside by the insulator 200. The forward end of the center electrode 100 protrudes from the forward end of the insulator 200. The rear end of the center electrode 100 extends toward the rear end side of the insulator 200. In the present embodiment, the rear end of the center electrode 100 is electrically connected a metal terminal 190.

The ground electrode 400 of the spark plug 10 is an electrically conductive electrode. The ground electrode 400 has a shape including a portion extending from the metallic shell 300 in the +Z axis direction and a portion bent toward the axial line CL. The rear end of the ground electrode 400 is joined to the metallic shell 300. The distal end of the ground electrode 400 and the center electrode 100 form the gap SG therebetween. In the present embodiment, the material of the ground electrode 400 is a nickel alloy containing nickel (Ni) as a main component, as is the material of the center electrode 100.

The insulator 200 of the spark plug 10 is a ceramic insulator which is electrically insulative. The insulator 200 has a tubular shape extending with the axial line CL at its center. In the present embodiment, the insulator 200 is produced by firing an insulating ceramic material (for example, alumina). The insulator 200 has an axial hole 290 that is a through hole extending with the axial line CL at its center. The center electrode 100 is held on the axial line CL within the axial hole 290 of the insulator 200 with the center electrode 100 protruding from the forward end of the insulator 200.

The insulator 200 has a forward trunk portion 210, a step portion 220, and a middle trunk portion 230. The forward trunk portion 210 of the insulator 200 is a tubular portion having an outer diameter decreasing from the rear end side to the forward end side. The center electrode 100 protrudes from the forward end of the forward trunk portion 210. The step portion 220 of the insulator 200 is located rearward of the forward trunk portion 210 to connect the forward trunk portion 210 to the middle trunk portion 230. The outer diameter of the step portion 220 increases from the forward trunk portion 210 toward the middle trunk portion 230. The middle trunk portion 230 of the insulator 200 is a tubular portion located rearward of the step portion 220. The outer diameter of the middle trunk portion 230 is larger than the outer diameter of the forward trunk portion 210. The detailed configuration of the insulator 200 will be described later.

The metallic shell 300 of the spark plug 10 is a conductive metal body. In the present embodiment, the material of the metallic shell 300 is carbon steel containing about 0.25% of carbon. In other embodiments, the material of the metallic shell 300 may be carbon steel containing less than 0.25% of carbon or may be carbon steel containing more than 0.25% of carbon. In the present embodiment, the outer circumferential surface of the metallic shell 300 is plated with nickel. In other embodiments, the outer circumferential surface of the metallic shell 300 may be plated with zinc or is not required to be plated.

The metallic shell 300 has a tubular shape extending with the axial line CL at its center. The metallic shell 300 is fixed to the outer side of the insulator 200 by crimping and is electrically insulated from the center electrode 100. The metallic shell 300 includes an end surface 310, a threaded portion 320, a forward hole portion 360, a ledge 370, and a middle hole portion 380.

The end surface 310 of the metallic shell 300 is an annular surface facing forward. The center electrode 100 and the insulator 200 protrude forward from the center of the end surface 310. The ground electrode 400 is joined to the end surface 310.

The threaded portion 320 of the metallic shell 300 is located outward of the forward hole portion 360, the ledge 370, and the middle hole portion 380 and is a portion of the outer circumference of the metallic shell 300 that has a male thread formed thereon. In the present embodiment, the nominal diameter of the male thread formed in the threaded portion 320 is M10. In other embodiments, the nominal diameter of the male thread formed in the threaded portion 320 may be smaller than M10 (for example, M8) or may be larger than M10 (for example, M12 or M14).

The forward hole portion 360 of the metallic shell 300 forms a hole with the axial line CL at its center, and a gap is formed between the forward hole portion 360 and the forward trunk portion 210 of the insulator 200. The ledge 370 of the metallic shell 300 is located rearward of the forward hole portion 360 to connect the forward hole portion 360 and the middle hole portion 380. The ledge 370 protrudes annularly inward from the forward hole portion 360 and the middle hole portion 380. Therefore, the ledge 370 supports the step portion 220 of the insulator 200 through the sheet packing 500. The middle hole portion 380 of the metallic shell 300 is located rearward of the ledge 370 and forms a hole in which a gap is formed between the middle hole portion 380 and the middle trunk portion 230 of the insulator 200. The detailed configuration of the metallic shell 300 will be described later.

The sheet packing 500 of the spark plug 10 is a member held between the step portion 220 of the insulator 200 and the ledge 370 of the metallic shell 300. The sheet packing 500 has an annular shape pressed and deformed between the step portion 220 and the ledge 370. In the present embodiment, the material of the sheet packing 500 is carbon steel containing about 0.15% of carbon. In other embodiments, the material of the sheet packing 500 may be carbon steel containing less than 0.15% of carbon or may be carbon steel containing more than 0.15% of carbon. In other embodiments, the material of the sheet packing 500 may be copper or stainless steel.

Figure 2:
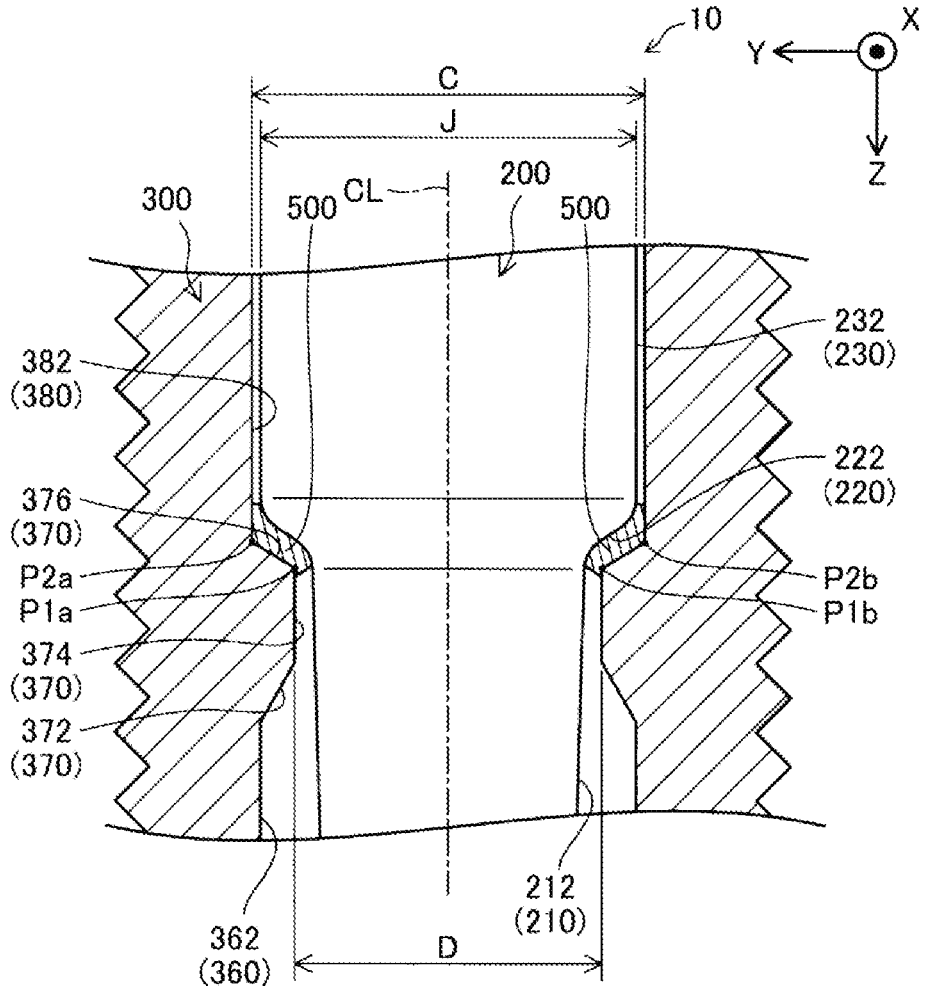
FIG. 2 is a partial enlarged view illustrating the spark plug, a step portion and a ledge being mainly illustrated.

FIG. 2 is a partial enlarged view illustrating the spark plug 10, the step portion 220 and the ledge 370 being mainly illustrated. FIG. 2 shows the external appearance of the insulator 200, a cross section of the metallic shell 300, and a cross section of the sheet packing 500. The cross sections of the metallic shell 300 and the sheet packing 500 shown in FIG. 2 are located on a virtual plane passing through the axial line CL.

The insulator 200 has an outer surface 212, an outer surface 222, and an outer surface 232. The outer surface 212 is the surface of the forward trunk portion 210. The outer surface 222 is a surface facing forward and is the surface of the step portion 220. The outer surface 232 is a surface along the axial line CL and is the surface of the middle trunk portion 230. In the present embodiment, the outer surface 212 and the outer surface 222 are connected smoothly. In the present embodiment, the outer surface 222 and the outer surface 232 are connected smoothly.

The metallic shell 300 has an inner surface 362, an inner surface 372, an inner surface 374, an inner surface 376, and an inner surface 382. The inner surface 362 is a surface along the axial line CL and is the surface of the forward hole portion 360. The inner surfaces 372, 374, and 376 are surfaces of the ledge 370. The inner surface 372 faces forward and is connected to the rear end of the inner surface 362. The inner surface 374 extends along the axial line CL and is connected to the rear end of the inner surface 372. The inner surface 376 faces rearward and is connected to the rear end of the inner surface 374. The inner surface 382 extends along the axial line CL and is the surface of the middle hole portion 380. The inner surface 382 is a first surface, the inner surface 374 is a second surface, and the inner surface 376 is a third surface.

A point P1*a* is the point of intersection of an extension of the inner surface 374 and an extension of the inner surface 376 in one half section in the +Y axis direction that is one of two half sections separated by the axial line CL. A point P2*a* is the point of intersection of an extension of the inner surface 376 and an extension of the inner surface 382 in the one half section in the +Y axis direction. A point P1*b* is the point of intersection of an extension of the inner surface 374 and an extension of the inner surface 376 in the other half section in the −Y axis direction that is the other one of the two half sections separated by the axial line CL. A point P2*b* is the point of intersection of an extension of the inner surface 376 and an extension of the inner surface 382 in the other half section in the −Y axis direction.

The inner diameter C of the middle hole portion 380 of the metallic shell 300 is equal to the distance between the point P2*a* and the point P2*b* along the Y axis. The inner diameter D of the ledge 370 of the metallic shell 300 is equal to the distance between the point P1*a* and the point P1*b* along the Y axis. The outer diameter J of the middle trunk portion 230 of the insulator 200 is smaller than the inner diameter C of the middle hole portion 380 and larger than the inner diameter D of the ledge 370.

The forward end of the sheet packing 500 may be formed to be located on the step portion 220 of the insulator 200 or may be formed to extend onto the forward trunk portion 210. The forward end of the sheet packing 500 may be formed to be located on the inner surface 376 of the ledge 370 of the metallic shell 300 or may be formed to extend onto the inner surface 374 of the ledge 370. The rear end of the sheet packing 500 may be formed to be located on the step portion 220 of the insulator 200 or may be formed to extend onto the middle trunk portion 230. The rear end of the sheet packing 500 is formed to extend onto the middle hole portion 380 of the metallic shell 300.

Figure 3:
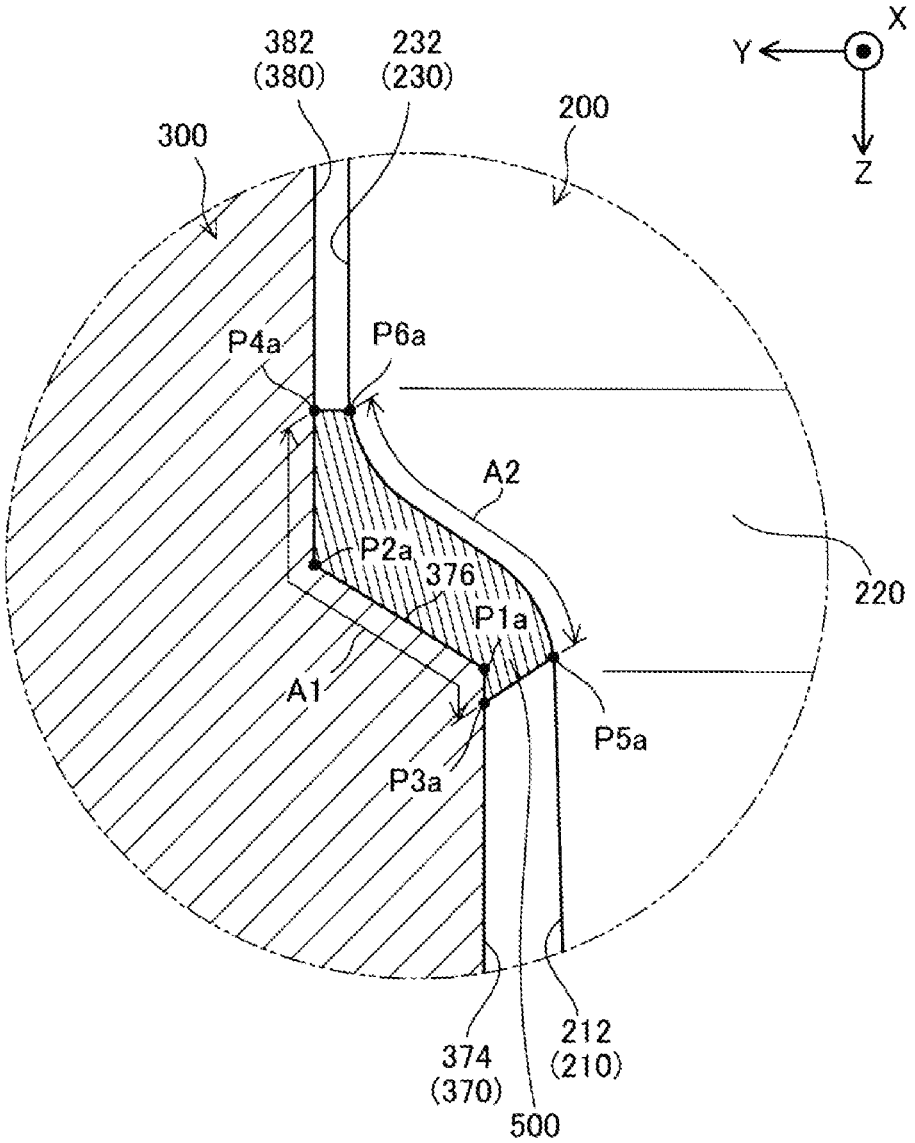
FIG. 3 is a partial enlarged view illustrating one of half sections that is located on a+Y axis direction side with a sheet packing at the center.

FIG. 3 is a partial enlarged view illustrating the one half section located on the +Y axis direction side with the sheet packing 500 at the center. A point P3*a* represents a forward end of the sheet packing 500 that is in contact with the metallic shell 300. A point P4*a* represents a rear end of the sheet packing 500 that is in contact with the metallic shell 300. A point P5*a* represents a forward end of the sheet packing 500 that is in contact with the insulator 200. A point P6*a* represents a rear end of the sheet packing 500 that is in contact with the insulator 200.

A length A1 is the length of contact between the metallic shell 300 and the sheet packing 500 in the half section in FIG. 3. In other words, the length A1 is the length from the point P3*a* to the point P4*a* through the point P1*a* and the point P2*a* along the surface of the metallic shell 300.

A length A2 is the length of contact between the insulator 200 and the sheet packing 500 in the half section in FIG. 3. In other words, the length A2 is the length from the point P5*a* to the point P6*a* along the surface of the insulator 200.

Figure 4:
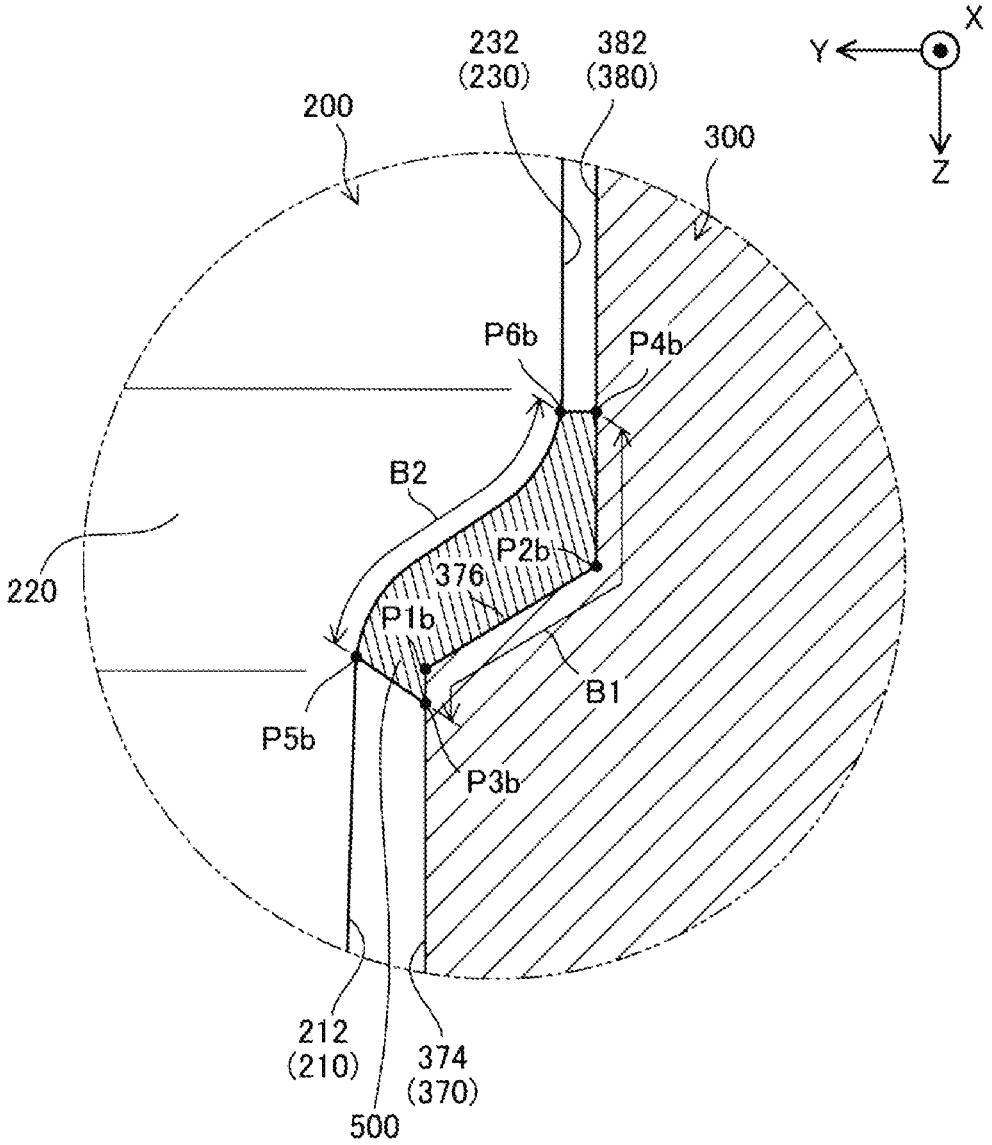
FIG. 4 is a partial enlarged view illustrating the other half section located on a −Y axis direction side with the sheet packing at the center.

FIG. 4 is a partial enlarged view illustrating the other half section located on the −Y axis direction side with the sheet packing 500 at the center. A point P3*b* represents a forward end of the sheet packing 500 that is in contact with the metallic shell 300. A point P4*b* represents a rear end of the sheet packing 500 that is in contact with the metallic shell 300. A point P5*b* represents a forward end of the sheet packing 500 that is in contact with the insulator 200. A point P6*b* represents a rear end of the sheet packing 500 that is in contact with the insulator 200.

A length B1 is the length of contact between the metallic shell 300 and the sheet packing 500 in the half section in FIG. 4. In other words, the length B1 is the length from the point P3*b* to the point P4*b* through the point P1*b* and the point P2*b* along the surface of the metallic shell 300.

A length B2 is the length of contact between the insulator 200 and the sheet packing 500 in the half section in FIG. 4. In other words, the length B2 is the length from the point P5*b* to the point P6*b* along the surface of the insulator 200.

From the viewpoint of improving heat dissipation through a path from the insulator 200 through the sheet packing 500 to the metallic shell 300, the value of (A+B)/M is preferably 2.8 or more and more preferably 2.9 or more, where A (mm) is the sum of the length A1 (mm) and the length A2 (mm), B (mm) is the sum of the length B1 (mm) and the length B2 (mm), and M (mm) is the difference obtained by subtracting the inner diameter D of the ledge 370 (mm) from the inner diameter C of the middle hole portion 380 (mm). The larger the value of (A+B)/M, the more effective it is in improving heat dissipation properties. The value of (A+B)/M may be, for example, 3.0, 4.0, or 5.0. Specifically, the value of (A+B)/M may be 5.0 or less, so long as it is 2.8 or more. The evaluation value of (A+B)/M will be described later.

Figure 5:
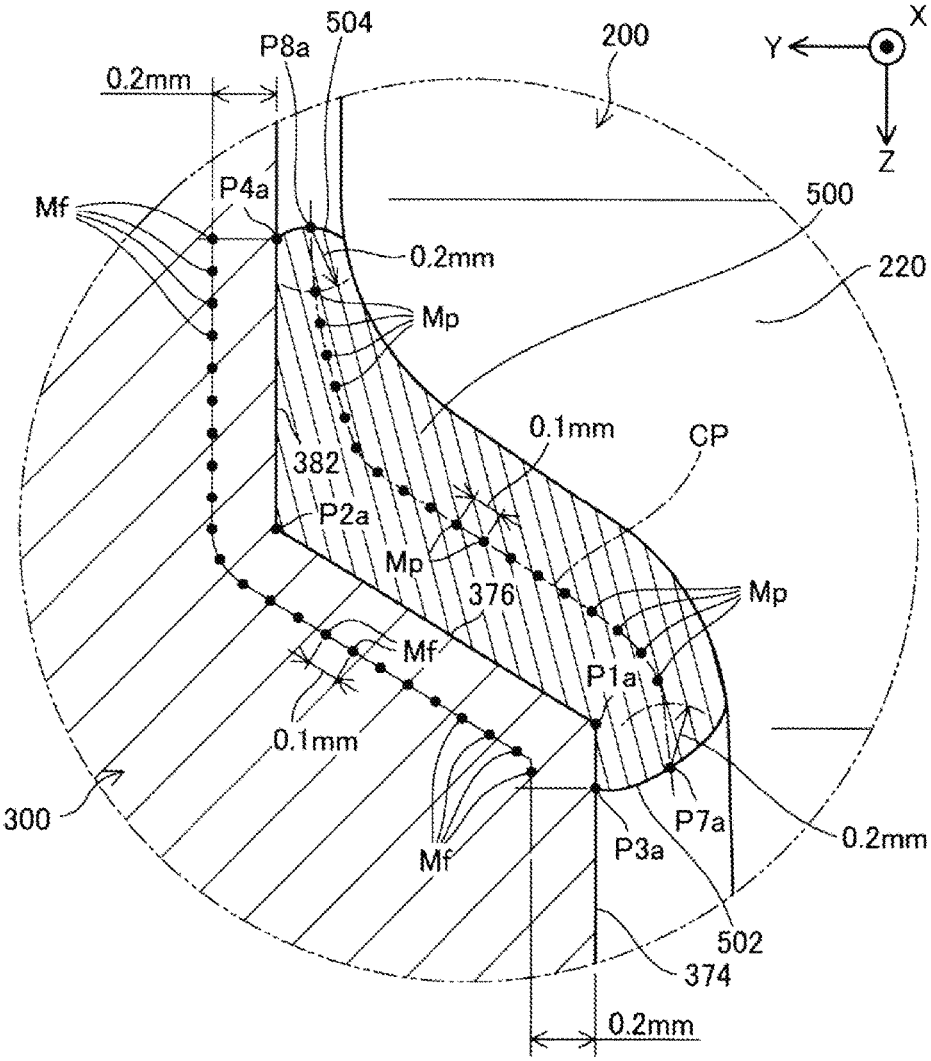
FIG. 5 is a partial enlarged view illustrating the one half section located on the +Y axis direction side with the sheet packing at the center.

FIG. 5 is a partial enlarged view illustrating the one half section located on the +Y axis direction side with the sheet packing 500 at the center. Points Mf are measurement points for measurement of the Vickers hardness of the metallic shell 300. Points Mp are measurement points for measurement of the Vickers hardness of the sheet packing 500. A point P7*a* is the midpoint of a forward boundary 502 of the sheet packing 500. A point P8*a* is the midpoint of a rear boundary 504 of the sheet packing 500. A center line CP is a line extending from the point P7*a* to the point P8*a* and passing through the center of the sheet packing 500.

The points Mf are located at a depth of 0.2 mm measured from a contact boundary P4*a*-P2*a*-P1*a*-P3*a* between the metallic shell 300 and the sheet packing 500 and are set from the rear end side at 0.1 mm intervals. In the present embodiment, points Mf are set similarly in the other half section located on the −Y axis direction side. The average Vickers hardness E of the metallic shell 300 is the average of Vickers hardness values measured at a plurality of points Mf.

The points Mp are located on the center line CP within the sheet packing 500 and are set at 0.1 mm intervals from a position separated 0.2 mm from the point P8*a* to a position within 0.2 mm from the point P7*a*. In the present embodiment, points Mp are set similarly in the other half section located on the −Y axis direction side. The average Vickers hardness F of the sheet packing 500 is the average of Vickers hardness values measured at a plurality of points Mp.

The Vickers hardness of the metallic shell 300 and the Vickers hardness of the sheet packing 500 are measured according to Japanese Industrial Standards JIS-Z-2244: 2009, and the measurement conditions are as follows.

Test class: Micro Vickers hardness test

Test force: 980.7 mN (millinewtons)

Test force duration time: 15 seconds

Indenter Approach speed: 60 μm/s (micrometers per second)

From the viewpoint of preventing the sheet packing 500 from being deformed excessively to thereby prevent the position of the insulator 200 relative to the metallic shell 300 from being excessively displaced toward the forward end side, it is preferable that the average Vickers hardness F of the sheet packing 500 is 100 HV or more. From the viewpoint of improving heat dissipation through the path from the insulator 200 through the sheet packing 500 to the metallic shell 300, it is preferable that the average Vickers hardness E of the metallic shell 300 is 240 HV or more and that the average Vickers hardness F of the sheet packing 500 is less than the average Vickers hardness E of the metallic shell 300. The evaluation values of the average Vickers hardnesses E and F will be described later.

Figure 6:
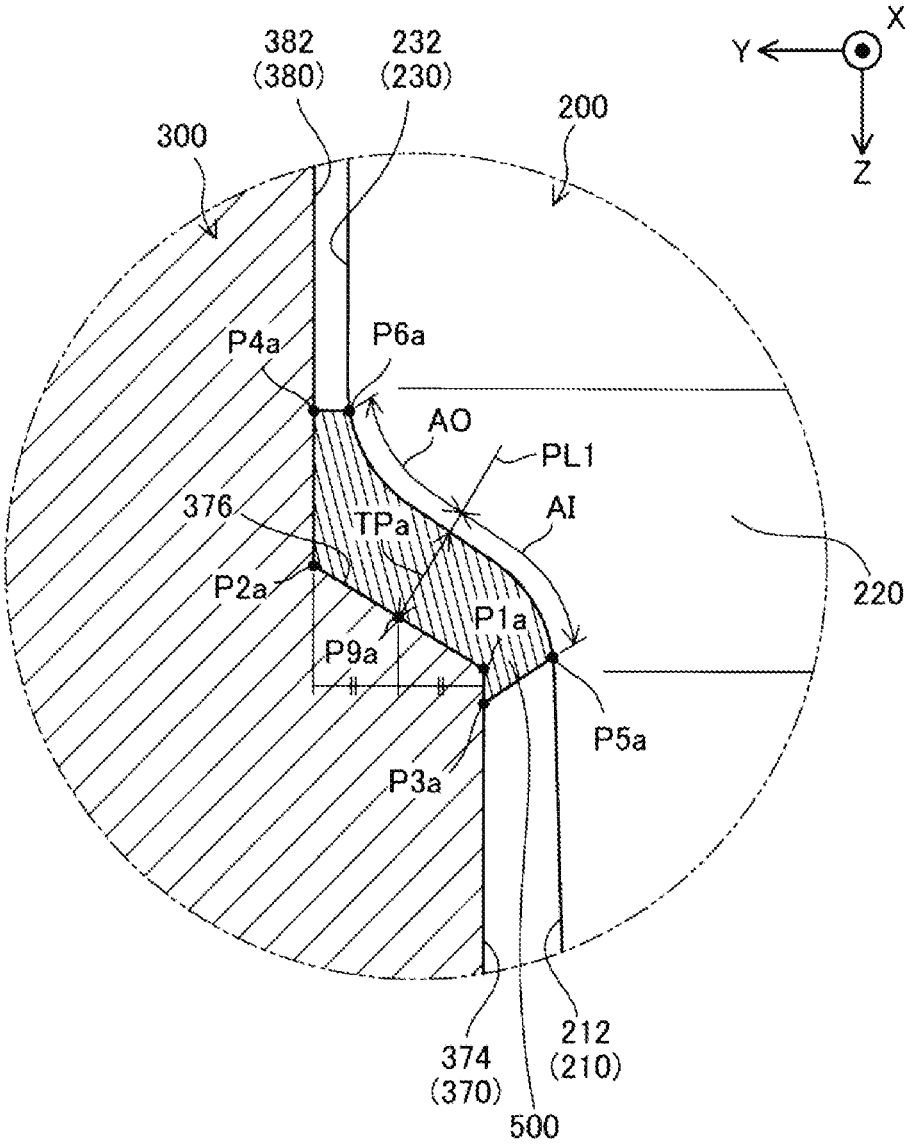
FIG. 6 is a partial enlarged view illustrating the one half section located on the +Y axis direction side with the sheet packing at the center.

FIG. 6 is a partial enlarged view illustrating the one half section located on the +Y axis direction side with the sheet packing 500 at the center. A point P9*a* is the midpoint of the inner surface 376 in the one half section located on the +Y axis direction side, i.e., the midpoint of a line segment connecting the point P1*a* and the point P2*a*. A thickness TPa is the thickness of the sheet packing 500 at the point P9*a*.

A perpendicular line PL1 is a line passing through the point P9*a* and perpendicular to the inner surface 376. A length AO is the length of contact between the insulator 200 and the sheet packing 500 on the outer circumferential side with respect to the perpendicular line PL1. A length AI is the length of contact between the insulator 200 and the sheet packing 500 on the inner circumferential side with respect to the perpendicular line PL1.

Figure 7:
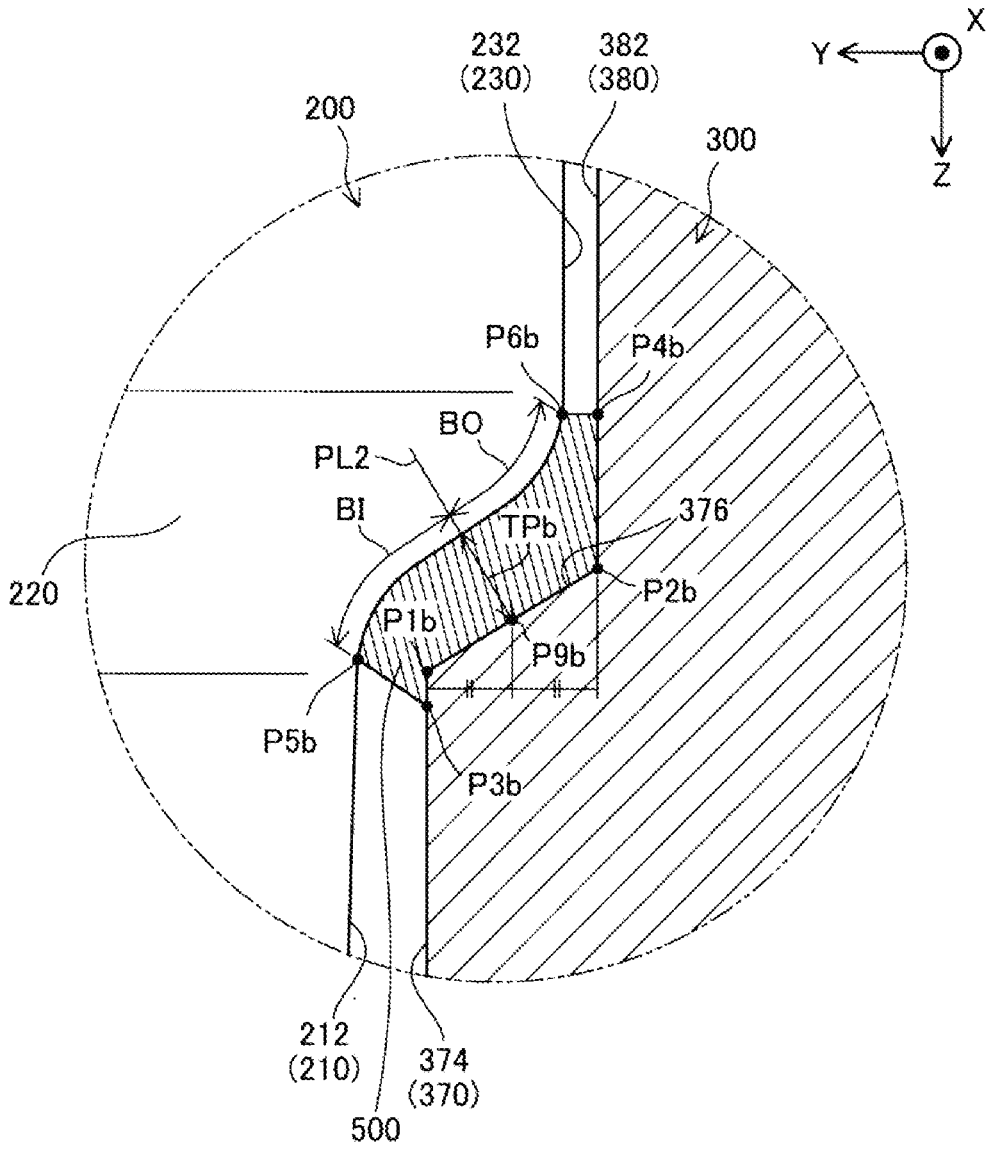
FIG. 7 is a partial enlarged view illustrating the other half section located on the −Y axis direction side with the sheet packing at the center.

FIG. 7 is a partial enlarged view illustrating the other half section located on the −Y axis direction side with the sheet packing 500 at the center. A point P9*b* is the midpoint of the inner surface 376 in the other half section located on the −Y axis direction side, i.e., the midpoint of a line segment connecting the point P1*b* and the point P2*b*. A thickness TPb is the thickness of the sheet packing 500 at the point P9*b*.

A perpendicular line PL2 is a line passing through the point P9*b* and perpendicular to the inner surface 376. A length BO is the length of contact between the insulator 200 and the sheet packing 500 on the outer circumferential side with respect to the perpendicular line PL2. A length BI is the length of contact between the insulator 200 and the sheet packing 500 on the inner circumferential side with respect to the perpendicular line PL2.

From the viewpoint of ensuring a sufficient allowance for deformation of the sheet packing 500 to thereby maintain the accuracy of installation of the insulator 200 to the metallic shell 300, the thickness TP of the sheet packing 500 is preferably 0.15 mm or more. From the viewpoint of further improving the heat dissipation through the path from the insulator 200 through the sheet packing 500 to the metallic shell 300, the thickness TP of the sheet packing 500 is preferably 0.30 mm or less and more preferably 0.20 mm or less. In the present embodiment, the thickness TP of the sheet packing 500 is the average of the thickness Tpa and the thickness TPb. The evaluation value of the thickness TP will be described later.

From the viewpoint of effectively improving the heat dissipation through the path from the insulator 200 through the sheet packing 500 to the metallic shell 300, the value of (AI+BI)/(AO+BO) is preferably 0.9 or more and more preferably 1.1 or more. The evaluation value of (AI+BI)/(AO+BO) will be described later.

A-2. Evaluation Tests

FIG. 8 is a table showing the results of evaluation of the value of (A+B)/M. In the evaluation test in FIG. 8, the tester evaluated a plurality of spark plugs 10, i.e., samples A1 to A9, different in the value of (A+B)/M and having threaded portions 320 with nominal diameters of M10, M12, and M14.

Specifications common to samples A1 to A9 are as follows.

Material of metallic shell 300: Carbon steel containing about 0.25% of carbon Material of sheet packing 500: Carbon steel containing about 0.15% of carbon Specifications common to samples A1 to A3 are as follows.

Nominal diameter of threaded portion 320: M10

Difference M (=C−D): 1.3 mm

Inner diameter C: 6.5 mm

Inner diameter D: 5.2 mm

Outer diameter J: 6.3 mm

Specifications common to samples A4 to A6 are as follows.

Nominal diameter of threaded portion 320: M12

Difference M (=C−D): 1.3 mm

Inner diameter C: 7.5 mm

Inner diameter D: 6.2 mm

Outer diameter J: 7.3 mm

Specifications common to samples A7 to A9 are as follows.

Nominal diameter of threaded portion 320: M14

Difference M (=C−D): 1.6 mm

Inner diameter C: 9.5 mm

Inner diameter D: 7.9 mm

Outer diameter J: 9.2 mm

In the evaluation test in FIG. 8, the tester first attached one of the samples to an engine for a load test. Then the engine for the load test was operated for 5 minutes while the engine speed was maintained at 6,000 rpm with the throttle fully open, and the number of knocking events that occurred during the operation was measured. Then the tester removed the sample from the engine for the load test, cut the sample along the axial line CL, and measured the dimensions of each section.

The tester evaluated the heat dissipation properties of each of the samples according to the following evaluation criteria. Pre-ignition causes knocking to occur. Therefore, the better the heat dissipation properties of the spark plug 10, the smaller the number of knocking events.

A (Good): No knocking events

B (Fair): 1 to 4 knocking events

C (Poor): 5 to 10 knocking events

F (Fail): 11 or more knocking events

According to the evaluation test in FIG. 8, to improve the heat dissipation properties of the spark plug 10, the value of (A+B)/M is preferably 2.8 or more and more preferably 2.9 or more, irrespective of the nominal diameter of the threaded portion 320.

FIG. 9 is a table showing the results of evaluation of the value of (A+B)/M. In the evaluation test in FIG. 9, the tester evaluated a plurality of spark plugs 10, i.e., samples A11 to A19, having sheet packings 500 formed of different materials and different in the value of (A+B)/M. The evaluation test in FIG. 9 is the same as the evaluation test in FIG. 8. The evaluation criteria in FIG. 9 are the same as the evaluation criteria in FIG. 8.

Specifications common to samples A11 to A19 are as follows.

Material of metallic shell 300: Carbon steel containing about 0.25% of carbon Nominal diameter of threaded portion 320: M10

Difference M (=C−D): 1.3 mm

Inner diameter C: 6.5 mm

Inner diameter D: 5.2 mm

Outer diameter J: 6.3 mm

A specification common to samples A11 to A13 is as follows.

Material of sheet packing 500: Carbon steel containing about 0.10% of carbon A specification common to samples A14 to A16 is as follows.

Material of sheet packing 500: Carbon steel containing about 0.25% of carbon A specification common to samples A17 to A19 is as follows.

Material of sheet packing 500: Carbon steel containing about 0.45% of carbon According to the evaluation test in FIG. 9, to improve the heat dissipation properties of the spark plug 10, the value of (A+B)/M is preferably 2.8 or more and more preferably 2.9 or more, irrespective of the material of the sheet packing 500.

FIGS. 10 and 11 are tables showing the results of evaluation of the average Vickers hardness E of the metallic shell 300 and the average Vickers hardness F of the insulator 200. In the evaluation test in FIGS. 10 and 11, the tester evaluated a plurality of spark plugs 10, i.e., samples B1 to B16, different in the average Vickers hardnesses E and F. The tester controlled the amount of deformation of the metallic shell 300 by plastic working to change the average Vickers hardness E of the metallic shell 300. The tester controlled the material of the sheet packing 500 (carbon content: 0.10 to 0.45%) to change the average Vickers hardness F of the insulator 200. The evaluation test in FIGS. 10 and 11 is the same as the evaluation test in FIG. 8. The evaluation criteria in FIGS. 10 and 11 are the same as the evaluation criteria in FIG. 8.

Specifications common to samples B1 to B16 are as follows.

Material of metallic shell 300: Carbon steel containing about 0.25% of carbon Material of sheet packing 500: Carbon steel containing about 0.15% of carbon Nominal diameter of threaded portion 320: M10

Difference M (=C−D): 1.3 mm

Inner diameter C: 6.5 mm

Inner diameter D: 5.2 mm

Outer diameter J: 6.3 mm

According to the evaluation test in FIGS. 10 and 11, it is preferable that the average Vickers hardness E of the metallic shell 300 is 240 HV or more, and it is preferable that the average Vickers hardness F of the sheet packing 500 is less than the average Vickers hardness E of the metallic shell 300.

FIG. 12 is a table showing the results of evaluation of the thickness TP of the sheet packing 500. In the evaluation test in FIG. 12, the tester evaluated a plurality of spark plugs 10, i.e., samples C1 to C5, different in the thickness TP of the sheet packing 500. Sample C5 corresponds to sample B11.

In the evaluation test in FIG. 12, the tester first attached one of the samples to an engine for a load test. Then the engine for the load test was operated for 5 minutes under a condition severer than that in the evaluation test in FIG. 8, i.e., while the engine speed was maintained at 7,000 rpm with the throttle fully open, and the number of knocking events that occurred during the operation was measured. Then the tester removed the sample from the engine for the load test, cut the sample along the axial line CL, and measured the dimensions of each section. The evaluation criteria in FIG. 12 are the same as the evaluation criteria in FIG. 8.

According to the evaluation test in FIG. 12, the thickness TP of the sheet packing 500 is preferably 0.30 mm or less and more preferably 0.20 mm or less.

FIG. 13 is a table showing the results of evaluation of the value of (AI+BI)/(AO+BO). In the evaluation test in FIG. 13, a plurality of spark plugs 10, i.e., samples D1 to D4, different in the value of (AI+BI)/(AO+BO) were evaluated. Sample D2 corresponds to sample B11.

In the evaluation test in FIG. 13, the tester first attached one of the samples to an engine for a load test. Then the engine for the load test was operated for 30 minutes under a condition severer than that in the evaluation test in FIG. 12, i.e., while the engine speed was maintained at 7,500 rpm with the throttle fully open, and the number of knocking events that occurred during the operation was measured. Then the tester removed the sample from the engine for the load test, cut the sample along the axial line CL, and measured the dimensions of each section. The evaluation criteria in FIG. 13 are the same as the evaluation criteria in FIG. 8.

According to the evaluation test in FIG. 13, the value of (AI+BI)/(AO+BO) is preferably 0.9 or more and more preferably 1.1 or more.

A-3. Effects

In the embodiments described above, 2.8≤(A+B)/M holds. Therefore, the area of contact between the insulator 200 and the sheet packing 500 and the area of contact between the sheet packing 500 and the metallic shell 300 can be ensured sufficiently, so that heat dissipation through the path from the insulator 200 through the sheet packing 500 to the metallic shell 300 can be improved.

The average Vickers hardness E of the metallic shell 300 is 240 HV or more, and the average Vickers hardness F of the sheet packing 500 is 100 HV or more and less than the average Vickers hardness E of the metallic shell 300. Therefore, the sheet packing 500 is prevented from being deformed excessively to thereby prevent the position of the insulator 200 relative to the metallic shell 300 from being excessively displaced toward the forward end side. In addition, heat dissipation through the path from the insulator 200 through the sheet packing 500 to the metallic shell 300 can be improved.

The thickness TP of the sheet packing 500 is 0.15 mm or more and 0.20 mm or less. Therefore, by ensuring a sufficient allowance for deformation of the sheet packing 500, the accuracy of installation of the insulator 200 to the metallic shell 300 can be maintained, and the heat dissipation through the path from the insulator 200 through the sheet packing 500 to the metallic shell 300 can be further improved.

When 1.1≤(AI+BI)/(AO+BO) holds, the sheet packing 500 is in contact with the insulator 200 to a larger extent on the forward end side than on the rear end side. In this case, the heat dissipation through the path from the insulator 200 through the sheet packing 500 to the metallic shell 300 can be effectively improved.

B. Other embodiments

The present invention is not limited to the above described embodiments, examples, and modifications and may be embodied in various other forms without departing from the spirit of the invention. For example, the technical features in the embodiments, examples, and variations corresponding to the technical features in the modes described in "SUMMARY OF THE INVENTION" can be appropriately replaced or combined to solve some of or all the foregoing problems or to achieve some of or all the foregoing effects. A technical feature which is not described as an essential feature in the present description may be appropriately deleted.

DESCRIPTION OF REFERENCE NUMERALS

10: spark plug
90: internal combustion engine
100: center electrode
190: metal terminal
200: insulator
210: forward trunk portion
212: outer surface
220: step portion

222: outer surface
230: middle trunk portion
232: outer surface
290: axial hole
300: metallic shell
310: end surface
320: threaded portion
360: forward hole portion
362: inner surface
370: ledge
372: inner surface
374: inner surface (second surface)
376: inner surface (third surface)
380: middle hole portion
382: inner surface (first surface)
400: ground electrode
410: electrode base metal
500: sheet packing
502: boundary
504: boundary
910: inner wall
920: combustion chamber Having described the invention the following is claimed:

1. A spark plug comprising:

a tubular insulator extending in an axial direction, parallel to an axial line, from a rear end side toward a forward end side, the insulator having a step portion having a surface facing the forward end side;

a tubular metallic shell for holding the insulator therein-side, the metallic shell including a ledge that supports the step portion and a middle hole portion located on the rear end side of the ledge and connected to the ledge; and a sheet packing held between the step portion and the ledge;

wherein the spark plug is characterized in that $2.8 \leq (A+B)/M$ holds, wherein A (mm) is a sum of a length A1 (mm) and a length A2 (mm), the length A1 being a length of contact between the sheet packing and the metallic shell in one of two half sections obtained by dividing, by the axial line, a cross section of the spark plug that passes through the axial line, the length A2 being a length of contact between the sheet packing and the insulator in the one of the two half sections, wherein B (mm) is a sum of a length B1 (mm) and a length B2 (mm), the length B1 being a length of contact between the sheet packing and the metallic shell in the other one of the two half sections that is different from the one of the two half sections, the length B2 being a length of contact between the sheet packing and the insulator in the other one of the two half sections, wherein, in a cross section of the metallic shell located on a virtual plane passing through the axial line:

an inner diameter D (mm) of the ledge is a distance measured on the virtual plane from one side of the ledge to another side of the ledge; and an inner diameter C (mm) of the middle hole portion is a distance measured on the virtual plane from one side of the middle hole portion to another side of the middle hole portion; and wherein M (mm) is a difference obtained by subtracting the inner diameter D (mm) of the ledge from inner diameter C (mm) of the middle hole portion.

2. A spark plug according to claim 1, wherein an average Vickers hardness E of a portion of the metallic shell that is located at a depth of 0.2 mm from an interface between the metallic shell and the sheet packing in the cross section is 240 HV or more, and wherein an average Vickers hardness F of the sheet packing in the cross section is 100 HV or more and less than the average Vickers hardness E.

3. A spark plug according to claim 1, wherein the ledge has an inner surface facing the rear end side, and wherein a thickness of the sheet packing at a midpoint of the inner surface in the cross section is 0.15mm or more and 0.20 mm or less.

4. A spark plug according to claim 1, wherein a male thread with a nominal diameter equal to or less than M14 is formed on an outer circumference of the metallic shell.

5. A spark plug according to claim 4, wherein the nominal diameter of the male thread is equal to or less than M10.

6. A spark plug according to claim 1, wherein the middle hole portion has a first inner surface along the axial line, wherein the ledge has:

a second inner surface along the axial line; and a third inner surface located between the first inner surface and the second inner surface and facing the rear end side, wherein a relation $1.1 \leq (AI+BI)/(AO+BO)$ holds, wherein AO is a length of contact between the sheet packing and the insulator on an outer circumferential side with respect to a perpendicular line PL1 in the one of the two half sections, the perpendicular line PL1 being drawn from a midpoint of the third inner surface in the one of the two half sections, wherein AI is a length of contact between the sheet packing and the insulator on an inner circumferential side with respect to the perpendicular line PL1 in the one of the two half sections, wherein BO is a length of contact between the sheet packing and the insulator on an outer circumferential side with respect to a perpendicular line PL2 in the other one of the two half sections, the perpendicular line PL2 being drawn from a midpoint of the third inner surface in the other one of the two half sections, and wherein BI is a length of contact between the sheet packing and the insulator on an inner circumferential side with respect to the perpendicular line PL2 in the other one of the two half sections.

* * * * *